US008425749B1

(12) United States Patent
Ravula et al.

(10) Patent No.: US 8,425,749 B1
(45) Date of Patent: Apr. 23, 2013

(54) MICROFABRICATED PARTICLE FOCUSING DEVICE

(75) Inventors: Surendra K. Ravula, Chicago, IL (US); Christian L. Arrington, Albuquerque, NM (US); Jennifer K. Sigman, Boise, ID (US); Darren W. Branch, Albuquerque, NM (US); Igal Brener, Albuquerque, NM (US); Paul G. Clem, Albuquerque, NM (US); Conrad D. James, Albuquerque, NM (US); Martyn Hill, Hants (GB); Rosemary June Boltryk, Cambridge (GB)

(73) Assignee: Sandia Corporation, Albuquerque, NM (US)

( * ) Notice: Subject to any disclaimer, the term of this patent is extended or adjusted under 35 U.S.C. 154(b) by 457 days.

(21) Appl. No.: 12/481,064

(22) Filed: Jun. 9, 2009

Related U.S. Application Data

(60) Provisional application No. 61/060,143, filed on Jun. 10, 2008.

(51) Int. Cl.
*B03C 5/02* (2006.01)

(52) U.S. Cl.
USPC ..... 204/643; 181/141

(58) Field of Classification Search ..... 204/643; 181/139, 141, 142
See application file for complete search history.

(56) References Cited

U.S. PATENT DOCUMENTS

2003/0159932 A1* 8/2003 Betts et al. ..... 204/547

FOREIGN PATENT DOCUMENTS

WO WO 01/05513 A1 * 1/2001

OTHER PUBLICATIONS

Ravula, S. K., et al., "A microfluidic system combining acoustic and dielectrophoretic particle preconcentration and focusing", Sensors and Actuators B, vol. 130, Mar. 28, 2008, p. 645-653.*

James, C. D. and M. Derzon, "Binary Electrokinetic Separation of Target DNA from Background DNA Primers", SANDIA Report, SAND2005-6230, Oct. 2005, p. 1-21.*

James, C.D. & M. Derzon, "Binary Electrokinetic Separation of Target DNA from Background DNA Primers", SANDIA Report, SAND2005-6230, Sandia National Laboratories, Oct. 2005.*

Coakley, W. Terence, "Cell and Particle Manipulation in an Ultrasound Standing Wave Trap", Proceedings of ICA, The 18th International Congress, Tokyo, 2004, vol. 5, pp. V-3713-V-3716.

W. T. Coakley, et al., "Analytical scale ultrasonic standing wave manipulation of cells and microparticles", Ultrasonics, 2000, pp. 638-641, vol. 38.

Jean-Luc Dion, "New Transmission Line Analogy Applied to Single and Multilayered Piezoelectric Transducers", IEEE Transactions on Ultrasonics, Ferroelectrics, and Frequency Control, vol. 40, No. 5 Sep. 1993, pp. 577-.

Jean-Luc Dion, et al., "Exact One-Dimensional Computation of Ultrasonic Transducers with Several Piezoelectric Elements and Passive Layers Using the Transmission Line Analogy", IEEE Transactions on Ultrasonics, Ferroelectrics, and Frequency Control, vol. 44, No. 5, Sep. 1997, pp. 1120-1131.

(Continued)

*Primary Examiner* — J. Christopher Ball
(74) *Attorney, Agent, or Firm* — Kevin W. Bieg

(57) ABSTRACT

A microfabricated particle focusing device comprises an acoustic portion to preconcentrate particles over large spatial dimensions into particle streams and a dielectrophoretic portion for finer particle focusing into single-file columns. The device can be used for high throughput assays for which it is necessary to isolate and investigate small bundles of particles and single particles.

9 Claims, 4 Drawing Sheets

OTHER PUBLICATIONS

N. G. Green and H. Morgan, "Dielectrophoretic investigations of sub-micrometre latex spheres", J. Phys. D: Appl. Phys. vol. 30 (1997) pp. 2626-2633.
A. Haake, et al, "Micro-manipulation of small particles by node position control of an ultrasonic standing wave", Ultrasonics, 2002, pp. 317-322, pp. 317-322.
N.R. Harris, et al, "A silicon microfluidic ultrasonic separator", Sensors and Actuators B, vol. 95 (2003) pp. 423-434.
Jeremy J. Hawkes et al, "Force field particle filter, combining ultrasound standing waves and laminar flow", Sensors and Actuators B, vol. 75. (2001) pp. 213-222.
David Holmes, et al, "High throughput particle analysis: Combining dielectrophoretic particle focusing with confocal optical detection", Biosensors and Bioelectronics, vol. 21, (2006) pp. 162-1630.
David Holmes, et al, "On-chip high-speed sorting of micron-sized particles for high-throughput analysis", IEEE proc-nanobiotechnol., vol. 152, No. 4, Aug. 2005, pp. 129-.
Krimholz, "New Equivalent Circuits for Elementary Piezoelectric Transducers", Electronics Letters, Jun. 25, 1970, vol. 6, No. 13, pp. 398-399.
Tobias Lilliehorn, et al, "Trapping of microparticles in the near field of an ultrasonic transducer", Ultrasonics, vol. 43, (2005), pp. 293-303.
Jeroen H. Nieuwenhuis, et al, "Optimization of Microfluidic Particle Sorters Based on Dielectrophoresis", IEEE Sensors Journal, vol. 5, No. 5, Oct. 2005, pp. 810-816.
Andreas Nilsson, et al, "Acoustic control of suspended particles in micro fluidic chips", Lab on a chip, vol. 4, 2004, pp. 131-.
Filip Petersson, et al, "Carrier Medium Exchange through Ultrasonic Particle Switching in Microfluidic Channels", Analytical Chemistry, vol. 77, No. 5, Mar. 1, 2005, pp. 1216-1221.
Claire Simonnet et al, "High-Throughput and High-Resolution Flow Cytometry in Molded Microfluidic Devices", Analytical Chemistry, vol. 76, No. 16, 2006, pp. 5653-5663.
R.J. Townsend. et al, "Investigation of two-dimensional acoustic resonant modes in a particle separator", Ultrasonics, 2006, vol. 44, pp. E467-.
S. Tsukahara et al, "Dielectrophoresis of microbioparticles in water with planar and capillary quadrupole electrodes", IEEE Proc. Nanobiotechnol. vol. 150, No. 2, 2003, pp. 59-.
M. Wiklund, et al, "Ultrasonic standing wave manipulation technology integrated into a dielectrophoretic chip," Lab on a chip, vol. 6, 2006, pp. 1537-.
Ren Yang, et al, "Microfabrication and test of a three-dimensional polymer hydro-focusing unit for flow cytometry applications". Sensors and Actuators A, 118 (2005) pp. 259-267.

* cited by examiner

Section A-A

MICROFABRICATED PARTICLE FOCUSING DEVICE

CROSS-REFERENCE TO RELATED APPLICATION

This application claims the benefit of U.S. Provisional Application No. 61/060,143, filed Jun. 10, 2008, which is incorporated herein by reference.

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to microfluidic devices and, in particular, to a microfabricated device that can be used to focus and sort particles for flow cytometry and other applications.

BACKGROUND OF THE INVENTION

Many biochemical procedures require isolating cells of a uniform type from a tissue containing a mixture of cell types. Flow cytometry is a technology that can simultaneously measure and then analyze physical characteristics of single particles, usually cells, as they flow in a fluid stream through a beam of light. For example, cell separation is often used to analyze the DNA content of individual cells. In a typical cell-separation technique, DNA or antibodies coupled to a fluorescent dye are used to label specific cells. FIG. 1 is a schematic illustration of a typical flow cytometer, wherein the individual cells, traveling single file, pass through a laser beam and the fluorescence of each cell is measured. For optimal illumination, the cells should be positioned in the center of the laser beam and only one cell should move through the laser beam at a given moment. Labeled cells can then be separated from unlabeled cells, for example using a vibrating nozzle to form droplets containing single cells. This technique can sort many thousands of cells per second.

However, commercial flow cytometers are bulky and expensive, precluding their use in field clinics, water monitoring, agriculture/veterinary diagnostics, and rapidly deployable biothreat detection. Much of the size and cost of conventional cytometers is dictated by the high speed achieved by cells or beads in a hydrodynamically focused stream. Recently, flow cytometry systems based on microfluidics have promised less expensive and portable alternatives to conventional systems. See R. Yang et al., *Sensors and Actuators A* 118, 259 (2005); and C. Simonnet and A. Groisman, *Analytical Chemistry* 78, 5653 (2006). These flow cytometry microsystems take advantage of the ability of micromachining technology to pattern small features and integrate multiple sensing modalities (optical, electrical, mechanical) onto a single platform. In addition, microfluidics offers the ability to build complex interrogation channels that can focus cells into narrow single-file columns for downstream optical interrogation. However, underlying issues (e.g., cell clumping and adhesion to the channel) and appropriate routing of the particles to necessary points in an integrated system remain problematic.

Acoustic force manipulation technologies have matured in the last ten years to enable reliable handling of particles in microsystems. See W. T. Coakley et al., *Ultrasonics* 38, 638 (2000); J. J. Hawkes and W. T. Coakley, *Sensors and Actuators B* 75, 213 (2001); A. Haake and J. Dual, *Ultrasonics* 40, 317 (2002); N. R. Harris et al., *Sensors and Actuators B* 95, 425 (2003); and A. Nilsson et al., *Lab on a Chip* 4, 131 (2004). These long-range acoustic forces can span the entire dimensions of large (e.g., hundreds of microns) fluidic channels. Moreover, the acoustic forces can be spatially decoupled to strengthen primary radiation forces in one dimension and reduce those in other directions. Also, the acoustic radiation forces that move particles from one position to another act on a different spatial scale from weaker interparticle forces. However, there are certain drawbacks to the use of acoustic forces alone to manipulate particles. For instance, the fabrication of the acoustic device requires non-traditional transducer materials that are difficult to integrate into microsystems. Further, acoustic focusing parameters can generally be changed only by changing frequencies to modify the number of standing wave nodes in the channel. Finally, coupling acoustic forces to devices is not straightforward and poses microfabrication limitations.

Meanwhile, dielectrophoresis (DEP) has been used for many applications in microsystems during the past few years. The DEP force enables particles to be moved precisely from one location to another using simple metal electrode configurations. Negative DEP has been used to levitate single particles at a particular point in a microsystem and to manipulate small groups of particles. See D. Holmes et al., *IEE Proceedings-Nanobiotechnology* 152, 129 (2005); J. H. Nieuwenhuis et al., *IEEE Sensors Journal* 5, 810 (2005); and D. Holmes et al., *Biosensors and Bioelectronics* 21, 1621 (2006). In many of these applications, the particles are manipulated for downstream analyses, such as impedance spectroscopy or chemical lysing. In many ways, DEP forces are complementary to acoustic forces. For instance, DEP forces are flexible and can be modified simply by changing frequencies or by addressing different sets of electrodes in an array to modify the shape of the DEP focusing.

Recently, Wiklund et al. have combined long-range ultrasonic standing wave (USWs), suitable for high-throughput manipulation of multi-particle aggregates, with short-range DEP, suitable for well-controlled and precise handling of individual cells, in a microfluidic chip. See M. Wiklund et al., *Lab on a Chip* 6, 1537 (2006), which is incorporated herein by reference. By combining USW and DEP, acoustic forces were used to accumulate particles into the multi-particle aggregates, and DEP forces were used to switch and combine particles between adjacent pressure nodes of the USWs in a microfluidic channel. However, Wiklund et al. used an acoustic transducer placed obliquely on a microfluidic chip to achieve lateral focusing of the bioparticles along the length of a microfluidic channel. With oblique coupling, the incident acoustic wave was transferred from a primarily vertical direction to a primarily horizontal direction by carefully matching of the transducer angle and the acoustic properties of the layers between the transducer and the horizontal channel, resulting in a complicated microsystem design.

Therefore, a need remains for a simplified microfabricated particle focusing device that enables the combination of acoustic focusing for large-scale particle preconcentration and dielectrophoretic forces for single-particle focusing and sorting of the preconcentrated particles.

SUMMARY OF THE INVENTION

The present invention is directed to a microfabricated particle focusing device comprising a substrate and an enclosed channel on the front side of the substrate for flow of a particle-containing fluid therein, the channel comprising an upstream acoustic portion comprising a piezoelectric transducer acoustically coupled to the back side of the substrate for establishing an ultrasonic standing wave field in the fluid having one or more pressure nodes or anti-nodes in the fluid flow direction, and a downstream dielectrophoretic portion comprising a microelectrode array disposed on the front side of the substrate for establishing one or more electric field gradient minima in the fluid in the fluid flow direction, wherein the particles in the particle-containing fluid are preconcentrated into one or more streams of particles along the pressure nodes or anti-nodes in the upstream acoustic portion when the piezoelectric transducer is energized and the streams are focused into one or more columns of particles in the downstream dielectrophoretic portion when the microelectrode array is energized.

The integration of acoustic forces and dielectrophoresis in the device enables preconcentration of dilute particle suspensions using large-scale acoustic forces with subsequent focusing of single particles to precise locations using DEP forces. The vertical and lateral alignment of particles with ultrasonic standing waves in the acoustic portion provides single-file columns of beads to be formed in the DEP portion. The device can be used in microfluidic assays, such as flow cytometry, where low coefficients of variance between similar cells are required for accurate data analysis. The precise alignment of beads in the acoustic focusing portion to evenly populate microparticles within the dielectrophoretic focusing portion is important to increase the throughput of cell analysis. For instance, once the particles of interest have been routed to the correct zone, they can be analyzed with optical detection in several parallel streams, or they can be trapped (by changing from negative- to positive-dielectrophoresis) and a second microfluidic network perpendicular to the routing network can be used to deliver chemical treatments of interest. The device provides a low-cost, portable platform for performing sophisticated bead-based or cellular assays.

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

FIG. 2A is top-view schematic illustration of the device. FIG. 2B is a cross-sectional end-view schematic illustration of the device.

FIG. 3(*a*) is a plot of the electrical impedance magnitude. FIG. 3(*b*) is a plot of the phase as a function of frequency for a PZT transducer with water in the channel. FIG. 3(*c*) is a plot of the computed total radiated power for a 1 V input. FIG. 3(*d*) is a cross-sectional plot of $\nabla E^2$ generated by the DEP interdigitated microelectrode structure.

FIG. 4(*a*) is a top-view photograph of the DEP portion without acoustic preconcentration. FIG. 4(*b*) is a top-view photograph of the DEP portion with acoustic preconcentration.

DETAILED DESCRIPTION OF THE INVENTION

Figure 1:
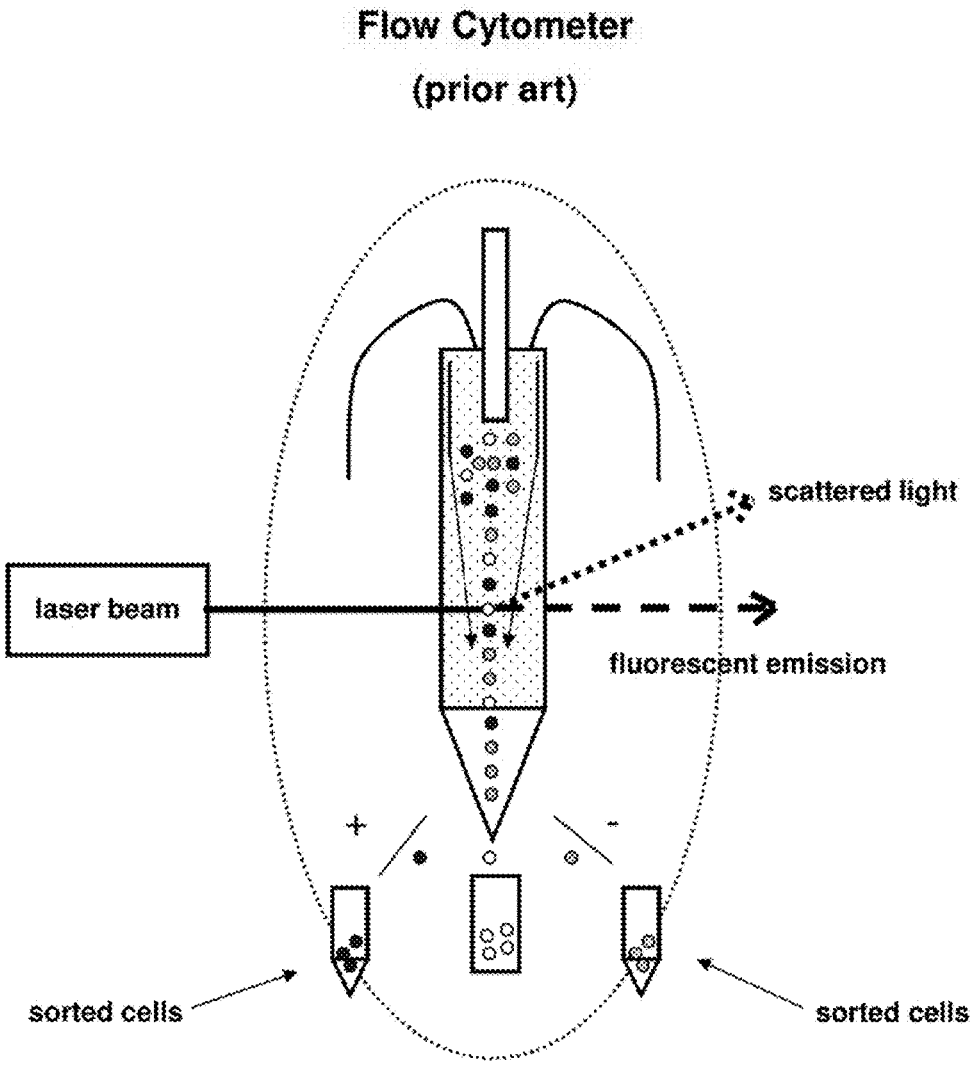
FIG. 1 is a schematic illustration of a flow cytometer.
Figure 2A:
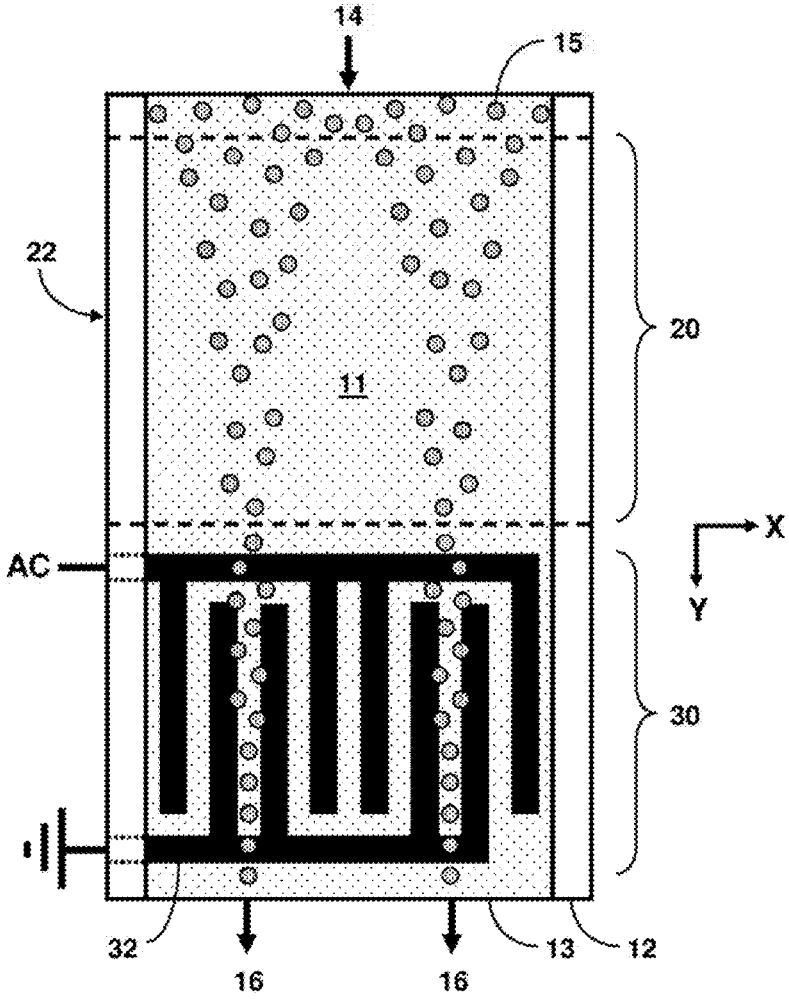
FIGS. 2A and 2B are schematic illustrations of a microfabricated particle focusing device that uses acoustic and DEP force for particle manipulation.
Figure 2B:
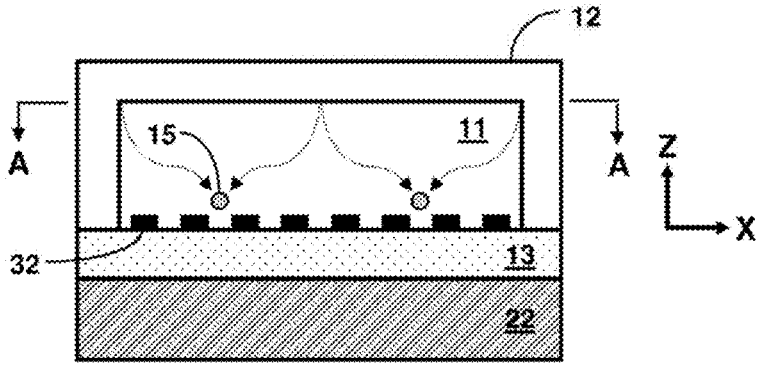

The present invention uses acoustic forces to concentrate particles into streams across large dimensions and subsequently uses short-range dielectrophoretic forces to focus the particles into one-dimensional columns of individual particles. FIGS. 2A and 2B show top-view and end-view schematic illustrations, respectively, of a microfabricated particle focusing device 10 of the present invention. The device 10 comprises an enclosed channel 11 formed by a lid 12 sealed to the front side of a substrate 13. A fluid 14 comprising a uniform suspension of particles 15 enters an inlet of the channel 11. The channel 11 comprises an upstream, acoustic portion 20, and a downstream, dielectrophoresis (DEP) portion 30. One or more one-dimensional columns 16 of single-file particles exit the outlet of the channel 11.

The particles are coarsely focused into one or more broad streams in the acoustic portion 20 before entering the DEP portion 30 of the channel. A piezoelectric transducer 22 is acoustically coupled to the back side of the substrate 13 under the acoustic portion 20 of the channel 11. Particles 15 are exposed to an ultrasonic standing wave (USW) field induced by the piezoelectric transducer 22 in the fluid flow. With the transducer 22 placed directly underneath the channel 11, the primary coupling occurs straight through a film stack to the fluid in the channel. The acoustic forces will penetrate the full cross-section (X-Z plane) of the fluidic channel for maximum particle preconcentration and coarse focusing. The channel preferably has a rectangular cross-section (as shown). The channel preferably has a uniform height and width, with smooth and straight sidewalls, to maintain a uniform wave field in the acoustic portion of the channel. The piezoelectric transducer can be energized by a radio frequency voltage source. The frequency can be tuned to establish an USW in the channel. For example, the acoustic frequency can be tuned to match one-half of the wavelength of the channel width to provide a single pressure node in the channel and causing the particles to be focused into a single stream in the fluid flow direction Y. Alternatively, the transducer can be tuned to match the first harmonic resonance mode ($2*\lambda/2$), creating two pressure nodes in the channel and causing the particles to be focused into two streams (as shown). Alternatively, the acoustic frequency can be tuned to provide a plurality of pressure nodes in the channel and, therefore, a plurality of particle streams.

In the DEP portion 30 of the channel comprises a microelectrode array 32 disposed on the front side of the substrate 13 that can be used for DEP manipulation of particles 15. The electrode array 32 can comprise interdigitated electrodes of opposing comb-shaped electrodes, each having a fingerlike periodic pattern of electrode fingers interdigitated with the electrode fingers of the opposing comb-shaped electrode (as shown). The electrode fingers can be oriented parallel to the fluid flow and comprise a finger pattern such that the DEP forces focus the streams from the acoustic portion into corresponding narrow single-file columns of particles parallel to the flow direction Y in the DEP portion. Alternative DEP electrode arranges can also be used. The electrodes can be formed of any suitable conductive material. The particle-containing fluid is in electromagnetic contact with the electrode fingers (i.e., the electric field generated by the interdigitated electrodes penetrates into the fluid). For example, the fluid can be in direct fluidic contact with the microelectrodes (as shown), or the fluidic channel can be separated from the microelectrodes by an insulating layer. The opposing electrodes can be activated by different applied AC biases to generate the spatially non-uniform electric field in the fluid above the electrodes. The DEP forces will largely be confined to the bottom portion of the channel, near the electrodes, and can be used for fine particle focusing. Narrow single-file columns 16 of particles emerge at the outlet of the channel 11.

The microfluidic particle focusing device can be used to provide a microfluidic flow cytometer, for example. The interdigitated microelectrodes confine particles laterally into single-file columns and levitate the particles to repeatable heights in the channel. This levitation places all particles within the same focusing plane for detection optics and keeps particles at the same velocity under pressure-driven flow. Finally, the horizontal confinement into narrow parallel columns in the present device keeps particles within the same streamlines and away from channel walls, which also simplifies integration with optical detection techniques.

Particle Focusing in the Acoustic Portion of the Channel

Ultrasonic standing wave fields can be used to separate particles suspended in a fluid. The acoustic radiation force will drive particles towards either the pressure nodes or the anti-nodes in the field, depending on the density and compressibility of the particles and the fluid. The steady-state acoustic force in a standing-wave field is a result of the nonlinear effect to the time-averaged acoustic radiation pressure around the particle. If only vertical forces are considered, the time-averaged acoustic force, $F_{USW}$, on a spherical particle suspended in a liquid is given by:

$$F_{USW} = \frac{\pi}{2\rho_l c_l^3}\left(f_1 + \frac{3}{2}f_2\right)r^3 p_0^2 v \sin\left(2\pi\frac{z}{\lambda/2}\right) \quad (1)$$

where p is the density, c is the sound velocity, r is the particle radius, $p_0$ is the pressure amplitude, v is the acoustic frequency, z is the vertical coordinate, λ is the acoustic wavelength in the fluid, and $f_1$ and $f_2$ are dimensionless corrections taking the compressibility of the particle into account, given by:

$$f_1 = 1 - \frac{\rho_l c_l^2}{\rho_p c_p^2},\ f_2 = \frac{(\rho_p - \rho_l)}{2\rho_p + \rho_l} \quad (2)$$

where the indices l and p denote the liquid and the particle, respectively. See A. Nilsson et al., *Lab on a Chip* 4, 131 (2004); and M. Wiklund et al., *Lab on a Chip* 6, 1537 (2006). If the first expression in brackets is positive (e.g., the particles are more dense than the liquid), the suspended particles will be trapped in the pressure nodal planes of the standing waves. However, ultrasonic standing wave forces are long-range, determined by the spacing between the pressure nodes. Therefore, the USW field is mainly useful for the pre-concentration of larger groups of particles.

In the device of the present invention, a standing wave can be created between the piezoelectric transducer in the bottom of the channel and the opposing reflecting top lid. If the acoustic frequency is tuned to match one-half of the wavelength of the channel width, a pressure nodal plane is established along the middle of the channel and a pressure anti-nodal plane along each channel wall. If the density and the compressibility of the particles are higher than the liquid, the particles will move toward the nodal plane while flowing through the channel. The entering, uniformly distributed particles are driven vertically toward the pressure nodal plane at the midplane of the channel. The particles are also centered laterally in the channel due to a lateral radiation force resulting from inhomogeneities in the pressure distribution in the nominally 'nodal' pressure plane, thereby causing them to aggregate near the center of the channel. The source of such lateral pressure variations in essentially planar designs can be attributed to a number of factors, for example, structural modes, enclosure modes, and near-field effects and give rise to the formation of striations or more complex patterns which are commonly observed in acoustic devices. Anisotropy and inhomogeneity of the transducer can also give rise to such variations. Strong lateral forces due to enclosure modes (i.e., two or three dimensional ultrasonic standing waves) have been exploited to separate particles. See A. Haake and J. Dual, *Ultrasonics* 42, 75 (2004); R. J. Townsend et al., *Ultrasonics* 44, e467 (2006); T. Lilliehorn et al., *Ultrasonics* 43, 293 (2005); and Petersson et al., *Analytical Chemistry* 77, 1216 (2005).

Particle Focusing in the DEP Portion of the Channel

Dielectrophoresis is more suitable for localized, three-dimensional manipulation of individual particles. The dielectrophoretic force on a spherical particle of radius r can be described by:

$$F_{DEP} = 2\pi r^3 \epsilon_m Re(K(w))\nabla E^2 \quad (3)$$

where $\epsilon_m$, is the permittivity of the medium, E is the electric field, and K(ω) is the Claussius-Mossoti factor given by:

$$K(\omega) = \frac{\varepsilon_p^* - \varepsilon_m^*}{\varepsilon_p^* + 2\varepsilon_m^*},\ \text{with } \varepsilon^* = \varepsilon - j\frac{\sigma}{\omega} \quad (4)$$

where $\epsilon^*_p$ and $\epsilon^*_m$ are the complex permittivities of the particle and medium, respectively. The surface conductivity, $\kappa_s$, on particles is typically dominant over the bulk conductivity $\sigma_b$ and can be accounted for by calculating the total particle conductivity as $\sigma_p = \sigma_b + 2\kappa_s/r$. See N. G. Green and H. Morgan, *Journal of Physics D: Applied Physics* 30, 2626 (1997). The DEP force is thus directly proportional to the gradient in the electric field $VE^2$, the volume of the particle, and the complex permittivity discontinuity between the particle and the suspending media. According to Eq. (3), the DEP force can have two polarities: positive DEP (pDEP) when Re[K(ω)]>0 and negative DEP (nDEP) when Re[K(ω)]<0. Particles that undergo pDEP will migrate to regions of large $\nabla E^2$ while particles that undergo nDEP will migrate to regions of minimal $\nabla E^2$. Negative DEP can be used to focus particles into single-particle flowing columns for cytometric analysis.

The Clausius-Mossotti factor is frequency-dependent, and thus the DEP force will also be frequency-dependent. The Maxwell-Wagner frequency, $f_{MW}$, is the critical frequency at which the particle-media system will transition from being dominated by the conductivities of the system to being dominated by the permittivities. See S. Tsukuhara and H. Watarai, *IEE Proceedings-Nanobiotechnology* 150, 59 (2003). The Maxwell-Wagner frequency is given by $$f_{MW} = \frac{\sigma_p + 2\sigma_m}{2\pi(\varepsilon_p + 2\varepsilon_m)} \quad (5)$$

For particles in water, nDEP occurs when the permittivities of the system dominate due to the large permittivity of water compared to nearly all other substances. For 10-μm diameter latex particles ($\epsilon_p$=2.6, $\sigma_p$=$10^{-7}$ S/m) suspended in deionized water ($\epsilon_m$=79, $\sigma_m$=$10^{-6}$ S/m), this frequency is on the order of $10^4$ Hz for normal particle surface conductivities (~1 nS).

Thus, at MHz frequencies, 10 μm polystyrene particles in deionized water will undergo nDEP.

Micro fabrication of a Particle Focusing Device

The microfabricated particle focusing device can be fabricated by techniques generally known to the IC manufacturing and MEMS industries. To investigate the operation of the present invention, experimental devices were fabricated using glass or Si substrates. Standard contact photolithography was used to create the inverse pattern of an interdigitated microelectrode array on a borosilicate glass wafer. Titanium (10-nm thickness) and gold (100-nm thickness) were evaporated onto the substrate and the resist was removed in a liftoff method using acetone and sonication. Once patterned, the glass slide or Si wafer was diced into 2 cm×1 cm chips. Each chip consisted of four sets of interdigitated electrodes. The microelectrodes were bi-pronged, with each leg and space set to 5 μm each. Each set of microelectrodes were connected together through a large bus that connected to a bonding pad.

After electrode fabrication, a glass microchannel lid was bonded to the top of the dielectrophoretic chip either by stamping a thin layer of PDMS to the chip (when a glass substrate was used) or through anodic bonding (when a Si substrate was used). The resulting microchannels on each chip were 10 mm long×750 μm wide×250 μm high. The 250 μm height of the channel was selected to support a half-wavelength resonance at 3 MHz and the width was selected to support a 3λ\2 resonance (a harmonic of the half-wavelength resonance) at 3 MHz. Fluidic interconnects were attached to the chip. For acoustic excitation, a lead zirconate titanate (PZT) transducer (BM400 composition) was bonded to the back side of the chip using cyanoacrylate glue. The BM400 composition material has similar characteristics to PZT4 and can achieve high drive amplitudes.

Model of Piezoelectric System in the Vertical Dimension

A 1-D transmission line model was developed to understand the coupling of acoustic energy along the height of the channel. The model was based on previous work to analyze lossy multilayered transducers. See J.-L. Dion, *IEEE Trans. Ultrason. Ferroelect. Freq. Contr.* 40, 577 (1993); and J.-L. Dion et al., *IEEE Trans. Ultrason. Ferroelect. Freq. Contr.* 44, 1120 (1997). The model used closed-form expressions for acoustic velocities and electric impedances of the piezoelectric element, valid in any one-dimensional system with losses. In the model there was no need for a non-intuitive negative capacitance $-C_o$ as used in the Mason equivalent circuit models for thickness vibrating piezoelectric elements. See W. P. Mason, "Physical Acoustics." New York: Academic Press, ch. 5, (1964) and R. Krimholtz et al., *Electron. Lett.* 6, 398 (1970). The approach is valid for thickness or shear vibrating elements.

The complex effective impedance $Z^*_e(\omega)$ of the piezoelectric element is given by:

$$Z_e^*(\omega) = \frac{1}{j\omega C_0} + \frac{|h_{33}|^2}{\omega^2 A}\cdot\left[\frac{2[\cosh(\gamma a)-1]Z_f + (Z_L+Z_R)\sinh(\gamma a)}{(Z_L Z_R + Z_f^2)\sinh(\gamma a) + Z_f(Z_L+Z_R)\cosh(\gamma a)}\right] \quad (6)$$

where $Z^*_f$ is the impedance of the piezoelectric film, γ is the complex propagation constant, ω is the angular frequency, a is the thickness of the piezoelectric element, $h_{33}=e_{33}/\epsilon^*_{33}$ is the piezoelectric stress constant, A is the transducer area, $C_o=\epsilon_{33}{}^s A/a$ is the clamped electrical capacitance at constant relative displacement S. The acoustic impedances $Z^*_L(\omega)$ and $Z^*_R(\omega)$ are the combined impedances seen below and above the piezoelectric element, respectively.

The combined impedance $Z^*(\omega)$ for an arbitrary number of layers can be computed using the impedance addition rule derived from transmission line theory. The complex transformed impedance at distance d=L−x by a layer is given by:

$$Z^*(\omega, x) = Z_i^*(\omega)\frac{Z_{LD}^*(\omega)\cosh[\gamma(L-x)] + Z_i^*(\omega)\sinh[\gamma(L-x)]}{Z_i^*(\omega)\cosh[\gamma(L-x)] + Z_{LD}^*(\omega)\sinh[\gamma(L-x)]} \quad (7)$$

where $Z^*_{LD}(\omega)$ is the load impedance, $Z^*_i(\omega)$ is the impedance of the intermediate layer, and L is the thickness of the intermediate layer. In general, $Z^*(\omega,x)$ is complex, except where $\gamma(L-x)=0$ or $\pi/2$ (mod π). The impedances $Z^*_L(\omega)$ and $Z^*_R(\omega)$, resulting from any number of piezoelectric or non-piezoelectric layers, can be computed and the results inserted into Eq. (6) to obtain the effective impedance of the structure. For the experimental devices, the properties of the transducer and electrodes were determined by fitting the theoretical model to the transducer in absence of additional external layers. The total radiated acoustic power in watts was calculated from the sum of left and right acoustic impedance and velocities resulting from the external layers on the transducer multiplied by the area.

Analysis of the Modeled System

Figure 3:
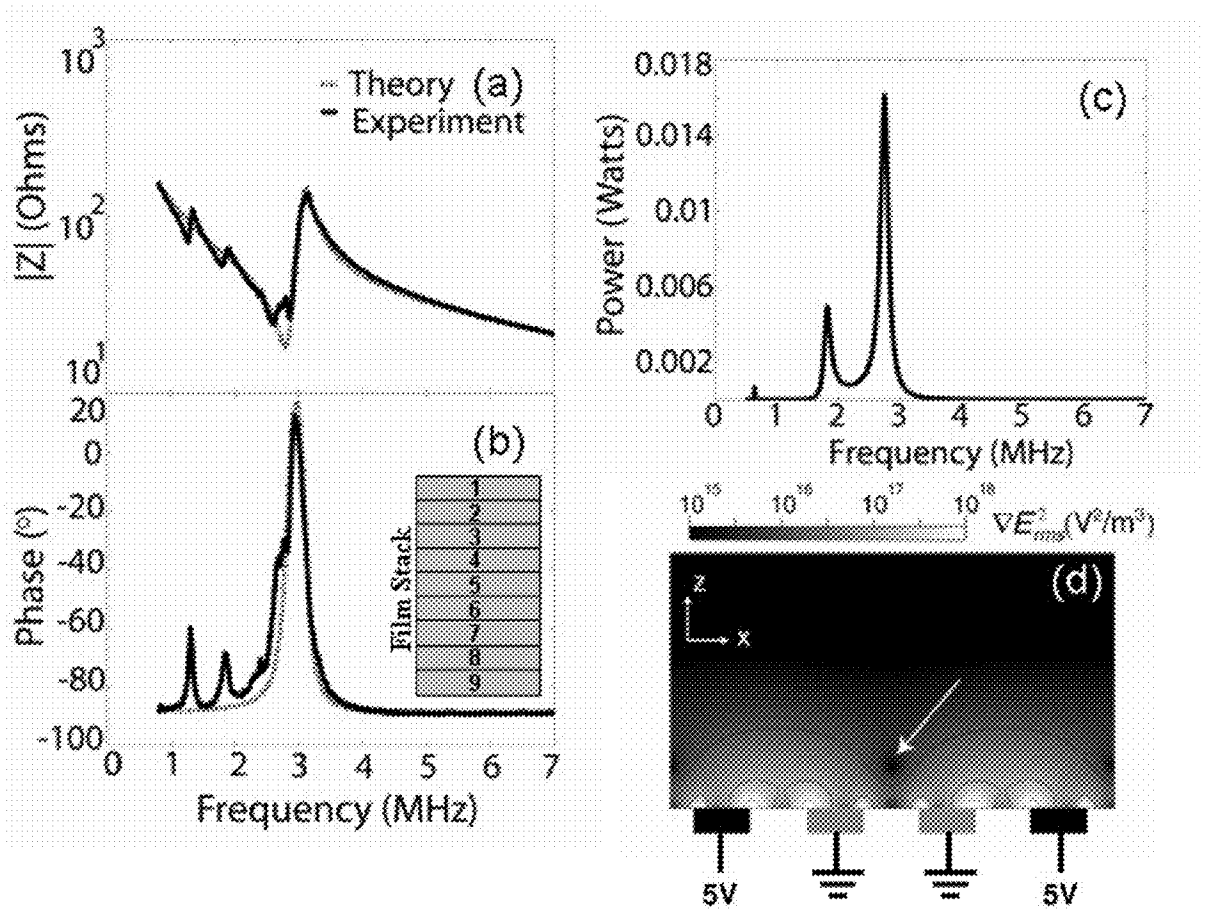
FIG. 3(*a*)-(*d*) are plots of experimental and modeling results of microfabricated particle focusing device characteristics.

FIG. 3 shows the experimental and modeling results of the device characteristics. The inset in FIG. 3(*b*) shows the stack of materials that was used to model the generation of an acoustic standing wave in the channel. The layers in the stack are: 1. air; 2. borofloat glass reflector; 3. microfluidic channel; 4. silicon substrate; 5. glue; 6. electrode; 7. PZT transducer; 8. electrode; and 9. air. FIG. 3(*a*) is a plot of the electrical impedance and FIG. 3(*b*) is a plot of the phase as a function of frequency for the BM400 PZT transducer with water in the channel. The measured resonance and anti-resonance frequencies were 2.70 MHz and 2.94 MHz, respectively. These plots show good agreement between the model and the experimental measurements for the composite transducer. FIG. 3(*c*) is a plot of the computed the total radiated power for a 1 V input. The radiated power was computed from the leftward and rightward velocities and the resulting impedances on each face of the transducer. The velocities were due to the total acoustic impedance seen at left and right interfaces. A maximum power output of 16.3 mW at 2.75 MHz and a secondary excitation peak of 5 mW at 1.83 MHz were computed. Finite element modeling was used to confirm that lateral enclosure modes exist within the channel structure with the vertical coupling mode.

FIG. 3(*d*) shows a two-dimensional cross-section simulation of the $\nabla E^2$ produced above the opposing fingers of a set of interdigitated microelectrodes shown in FIG. 2B. The fingers of the interdigitated electrodes (5 μm wide, 5 μm spaces) were held at either 5 V or 0 V. This electrode design was chosen to maximize the focusing capability on 10 μm beads. Symmetry is taken in the y direction and about the x=0 μm and x=40 μm axes. The maxima in $\nabla E^2$ are located at the edges of the electrodes, with the largest gradients occurring between electrodes held at 5 V and 0 V. Minima in $\nabla E^2$ occur in the gaps between the fingers of each split finger electrode (FIG. 3(*d*), white arrow). Particles that undergo nDEP will migrate to these minimum gradient regions, and thus be levitated several microns above the surface of the electrode chip. The levitation height is determined by the balance of the nDEP force and the weight and buoyancy of the particle.

Experimental Apparatus for Particle Manipulation

Ten micron diameter polystyrene microparticles were used for focusing experiments. A syringe pump was used to deliver particles (concentration of $10^6$ particles/mL) to the microchannel at a rate of 10 μL/min. The PZT transducer and the DEP electrodes were driven with separate function generators with a sinusoidal signal. The device was placed under an upright microscope and video photographs were captured. Probe tips were used to provide contact to the DEP electrodes and alligator clip connectors were connected to wires soldered to two faces of the PZT transducer for acoustic manipulation. Acoustic forces were coupled into the microfluidic channel from the substrate to create standing waves along the height and along the width of the channel. Once actuated, the average stream widths and average levitation heights for beads were measured by calibration of the microscope focus dial.

Device Characterization

The acoustic portion of the device was designed for λ\2 operation vertically and 3λ\2 laterally. The fundamental half-wavelength frequency for the experimental device occurred at approximately 3.1 MHz in the vertical direction and 0.95 MHz in the lateral direction. Table 1 summarizes the particle manipulation characteristics in both the acoustic and dielectrophoretic focusing portions (i.e., zones) of the'channel. The average stream width and levitation height in both the acoustic and dielectrophoretic portions was measured to confirm that the device was operating as designed. In particular, flow cytometry requires very tightly focused channels of particles.

The device can be used in either a continuous flow-through mode with nDEP or in a static interrogation mode by the trapping of beads to the substrate with pDEP. Once the particles enter the dielectrophoretic focusing portion, they can continue to flow through the device or can be trapped along the fingers of the interdigitated electrode array by changing from an nDEP to a pDEP force. With this device, beads could be trapped at 4-5 kHz (i.e., below the Maxwell-Wagner frequency) against the flow and held in place by pDEP. The trap allowed the particles to be pulled directly down to the substrate without disturbing the pearl chain alignment in the column. Once the particle is trapped it can then be interrogated optically or addressed chemically. The beads can then be released by reversing from pDEP to nDEP. Therefore, when the frequency of operation was switched back to nDEP (at 1 MHz) with this device, the beads were released from the substrate and allowed to resume flow to the channel outlet. Interrogation of functionalized beads is important for applications such as biomarker/protein detection involved in various physiological and pathological processes.

Operation at Vertical and Lateral Resonance

When the device was operated at 3 MHz, three streams of beads were created in the acoustic portion to feed three different sections of the DEP substrate, with minimal clumping due to uneven distributions in one section of the substrate. Pearl chains of beads averaged 12-15 beads and spanned the width of 7-8 fingers of the interdigitated electrodes. Within the preconcentration acoustic portion, only a small fraction (<1%) of the beads were lost due to unwanted sticking on the surface of the channel.

Operation at Lateral on-Resonance and Vertical Off Resonance

As shown in Table 1, the device was operated at acoustic frequencies from 1 to 10 MHz to better understand the behavior of the device at higher numbers of streams and any potential deleterious effects when the device was operated off resonance in the vertical dimension. In the off-resonance mode of operation, approximately 5% of the beads were lost due to sticking on the surface, especially during runs that lasted more than 5 minutes. At lower stream numbers, only one section of the DEP substrate was fed by beads; the other areas were empty resulting in clumps of beads and inefficient focusing into single file lines, as shown in Table 1. Higher numbers of lateral striations (e.g., 7-10 streams) increased the uniformity of the single file lines and allowed the DEP portion of the substrate to be evenly distributed with pearl chains.

These results also show that the device can be used effectively both on- and off-resonance vertically. While performance is better when the device is operated on-resonance vertically and laterally, only a modest increase (−5%) in loss of microparticles due to sticking to channel surfaces was observed when the device was operated off-resonance vertically. Off-resonance operation increases the potential throughput of the device by allowing more lateral streams feeding a much larger DEP substrate. Further, increasing the number of acoustically focused streams increases the focusing fidelity of the DEP substrate.

TABLE 1

Bead focusing characteristics during PZT actuation (number of experiments = 6)

| | Acoustic Focusing Zone | | | | Dielectrophoretic Focusing Zone | |
|---|---|---|---|---|---|---|
| Frequency of Operation (MHz) | Amplitude of Applied Voltage (V) (peak-to-peak) | Number of Streams | Average Stream Width (μm) | Average Levitation Height (μm) | Average "Pearl-chain Width" (μm) | Average Levitation Height (μm) |
| 0.95 | 16.17 | 1 | 323 ± 25 | 40 ± 22 | 32 ± 5 | 12 ± 2 |
| 2.2 | 16.13 | 2 | 300 ± 15 | 52 ± 16 | 35 ± 3 | 15 ± 6 |
| 3.1 | 11.23 | 3 | 251 ± 19 | 120 ± 25 | 16 ± 3 | 9 ± 5 |
| 4.12 | 17.13 | 4 | 112 ± 21 | 40 ± 18 | 23 ± 1 | 8 ± 2 |
| 5.06 | 16.19 | 5 | 109 ± 18 | 47 ± 19 | 13 ± 4 | 13 ± 6 |
| 6.1 | 12.59 | 6 | 119 ± 13 | 79 ± 25 | 11 ± 4 | 11 ± 2 |
| | | | | 167 ± 14 | | |
| 6.9 | 17.57 | 7 | 89 ± 21 | 48 ± 21 | 10 ± 2 | 12 ± 2 |
| 8.1 | 16.87 | 8 | 77 ± 17 | 56 ± 15 | 11 ± 4 | 11 ± 1 |
| 9.02 | 13.47 | 9 | 70 ± 16 | 60 ± 13 | 12 ± 5 | 14 ± 5 |
| | | | | 120 ± 14 | | |
| | | | | 180 ± 14 | | |
| 10.1 | 17.22 | 10 | 65 ± 13 | 62 ± 22 | 12 ± 2 | 10 ± 5 |

Values are mean ± standard error of measurement.

Operation of the Dielectrophoretic Portion Alone

When operating the device without the acoustic portion, a much greater variability in pearl chain widths was observed in the DEP portion, as shown in Table 2. In this experiment, the particles were delivered to the DEP portion with the acoustic transducer turned off. Beads were unevenly distributed throughout the substrate, with some areas being inundated with beads and others receiving very few. In the parts of the substrate that received many beads, particle clumping was also a problem.

TABLE 2

Bead focusing characteristics during DEP actuation alone (number of experiments = 6)

| Frequency of Operation (MHz) | Amplitude of Applied Voltage (V) (peak-to-peak) | Average "Pearlchain Width" (μm) | Average Levitation Height (μm) |
|---|---|---|---|
| 0.95 | 16.17 | 23 ± 5 | 14 ± 3 |
| 2.2 | 16.13 | 42 ± 12 | 17 ± 5 |
| 3.1 | 11.23 | 36 ± 13 | 19 ± 7 |
| 4.12 | 17.13 | 52 ± 14 | 21 ± 2 |
| 5.06 | 16.19 | 62 ± 21 | 14 ± 6 |
| 6.1 | 12.59 | 53 ± 13 | 17 ± 4 |
| 6.9 | 17.57 | 64 ± 20 | 16 ± 15 |
| 8.1 | 16.87 | 59 ± 19 | 15 ± 6 |
| 9.02 | 13.47 | 65 ± 21 | 16 ± 5 |
| 10.1 | 17.22 | 72 ± 22 | 15 ± 5 |

Values are mean ± standard error of measurement.

Figure 4B:
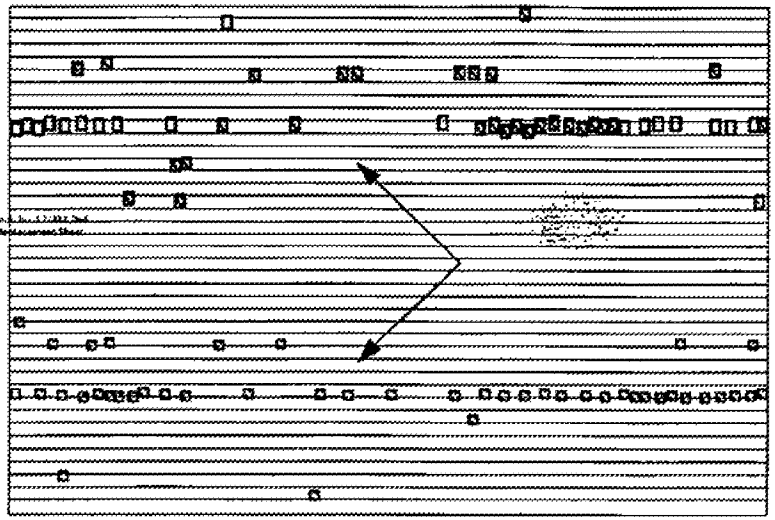
FIGS. 4(*a*)-(*b*) are photographs of the particle alignment with and without operation of the acoustic portion of the device.
Figure 4A:
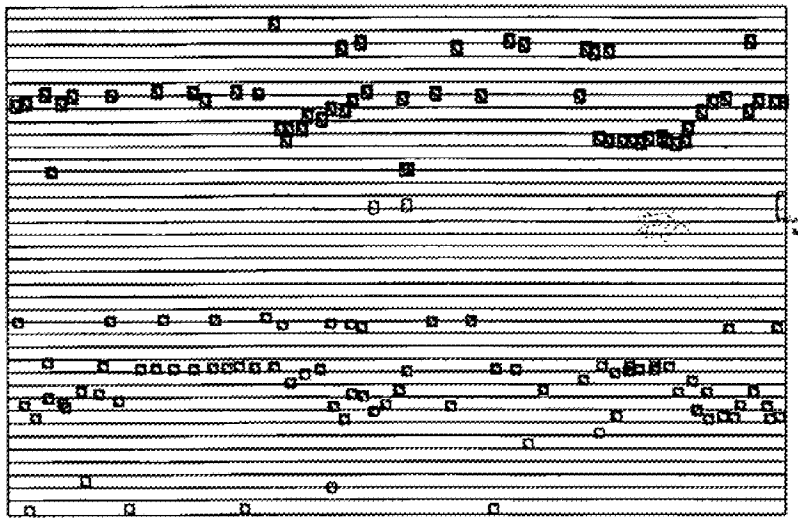

FIG. 4 shows particle alignment with and without operation of the acoustic portion of the device. FIG. 4(*a*) is a top-view photograph of the DEP portion without acoustic preconcentration. FIG. 4(*b*) is a top-view photograph of the DEP portion with acoustic preconcentration. In the latter photograph, the acoustic portion was operated at 8.1 MHz with a 16.87 Vp-p drive signal, producing eight streams that fed the dielectrophoretic focusing portion, resulting in very focused, aligned "pearl chains" of 10 μm beads (arrows). The upstream acoustic focusing portion minimizes the variability in the particle positions by coarsely focusing particles before fine adjustment is made by the dielectrophoretic portion. This reduction in variability enables higher fidelity optical signal measurements for applications, such as flow cytometry, that use beads and cells. The combined manipulation schemes enabled a continuous flow of $10^6$-$10^7$ particles/mL through the device and minimized the sticking of beads to channel walls and particle-particle clumping.

The present invention has been described as a microfabricated particle focusing device. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A microfabricated particle focusing device, comprising:

a substrate having a front side and a back side; and an enclosed channel, on the front side of the substrate for flow of a particle-containing fluid therein, the channel comprising:

an upstream acoustic portion comprising a piezoelectric transducer acoustically coupled to the back side of the substrate that couples acoustic energy straight through the substrate into the fluid for establishing an ultrasonic standing wave field in the fluid having one or more pressure nodes or anti-nodes in plane with the front side of the substrate in the fluid flow direction, and a downstream dielectrophoretic portion, separate from the upstream acoustic portion, comprising a microelectrode array disposed on the front side of the substrate for establishing one or more electric field gradient minima in the fluid in the fluid flow direction;

wherein the particles in the particle-containing fluid are preconcentrated into one or more streams of particles along the pressure nodes or anti-nodes in the upstream acoustic portion when the piezoelectric transducer is energized with a radiofrequency voltage and the streams are focused into one or more columns of flowing particles near the electric field gradient minima in the downstream dielectrophoretic portion when the microelectrode array is energized with an alternating current voltage.

2. The microfabricated particle focusing device of claim 1, further comprising means for reversing the polarity of the alternating current voltage, thereby trapping the particles near one or more electric field gradient maxima in the downstream dielectrophoretic portion.

3. The microfabricated particle focusing device of claim 1, wherein the channel has a rectangular cross section.

4. The microfabricated particle focusing device of claim 1, wherein the channel has a uniform height and width.

5. The microfabricated particle focusing device of claim 4, wherein the acoustic frequency of the ultrasonic standing wave field is tuned to match one-half of the wavelength of the channel width.

6. The microfabricated particle focusing device of claim 4, wherein the acoustic frequency of the ultrasonic standing wave field is tuned to match a harmonic resonance mode of $n*\lambda/2$ of the channel width, where n is an integer and $\lambda$ is the wavelength of the channel width.

7. The microfabricated particle focusing device of claim 1, wherein the microelectrode array comprises at least one interdigitated electrode of opposing comb-shaped electrodes, each comb-shaped electrode having a fingerlike pattern of electrode fingers interdigitated with the electrode fingers of the opposing comb-shaped electrode.

8. The microfabricated particle focusing device of claim 1, wherein the electrode fingers of each comb-shaped electrode is bi-pronged.

9. The microfabricated particle focusing device of claim 1, wherein the height of the channel is greater than 40 μm.

* * * * *